United States Patent [19]

Cole

[11] Patent Number: 4,802,797

[45] Date of Patent: Feb. 7, 1989

[54] MATERIAL APPLICATOR ASSEMBLY AND WIPER THEREFOR

[76] Inventor: Rodney D. Cole, 24 Pine Walk, Cobham, Surrey, England

[21] Appl. No.: 865,081

[22] Filed: May 19, 1986

[30] Foreign Application Priority Data

May 22, 1985 [GB] United Kingdom ..... 8512802
Mar. 5, 1986 [GB] United Kingdom ..... 8605342

[51] Int. Cl.[4] ..... A45D 40/26

[52] U.S. Cl. ..... 401/122; 401/127; 401/129

[58] Field of Search ..... 401/121, 122, 126, 127, 401/129, 130, 132, 85; 132/88.7

[56] References Cited

U.S. PATENT DOCUMENTS

| | | | |
|---|---|---|---|
| 2,170,222 | 8/1939 | Strauss | 401/122 |
| 3,214,782 | 11/1965 | Masters et al. | 401/129 X |
| 3,471,224 | 10/1969 | Melocchi | 401/122 |
| 3,529,899 | 9/1970 | Gruska | 401/121 |
| 3,692,417 | 9/1972 | Aston | 401/122 |
| 3,908,675 | 9/1975 | Spctz et al. | 401/122 X |
| 4,241,743 | 12/1980 | Schnabel et al. | 132/88.7 |
| 4,403,624 | 9/1983 | Montgomery | 401/122 X |
| 4,467,533 | 8/1984 | Sica | 401/122 X |
| 4,609,300 | 9/1986 | Robert | 401/122 |
| 4,627,454 | 12/1986 | Dahm | 132/88.7 |
| 4,628,950 | 12/1986 | Bitzer | 132/88.7 |
| 4,671,689 | 6/1987 | Gueret | 132/88.7 X |

FOREIGN PATENT DOCUMENTS

| | | | |
|---|---|---|---|
| 0099288 | 6/1984 | European Pat. Off. | 401/122 |
| 202932 | 11/1986 | European Pat. Off. | 401/122 |
| 204466 | 12/1986 | European Pat. Off. | 401/122 |
| 2097662 | 11/1982 | United Kingdom | 401/122 |

*Primary Examiner*—Randolph A. Reese
*Assistant Examiner*—Anthony Knight
*Attorney, Agent, or Firm*—Lerner, David, Littenberg, Krumholz & Mentlik

[57] ABSTRACT

A material applicator for use with cosmetic materials is constructed of an elongated applicator, a container for the material to be applied by the applicator and a wiper unit. The wiper unit includes a wiping orifice for wiping a material-retaining portion of the applicator as it is withdrawn from the container so as to limit the amount of material retained thereon. A cleaning member is provided which projects inwardly relative to the orifice and penetrates an inner part of the material-retaining portion to aid the removal of material from the inner part.

19 Claims, 5 Drawing Sheets

FIG. 8.
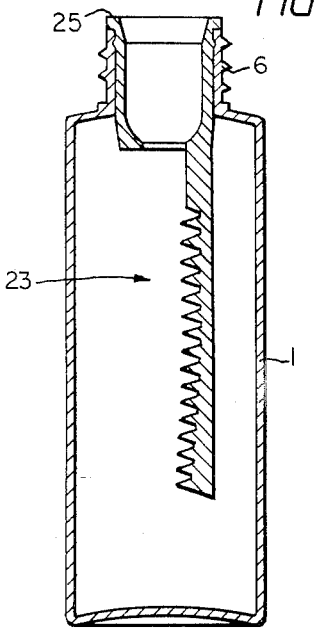
FIG. 9.
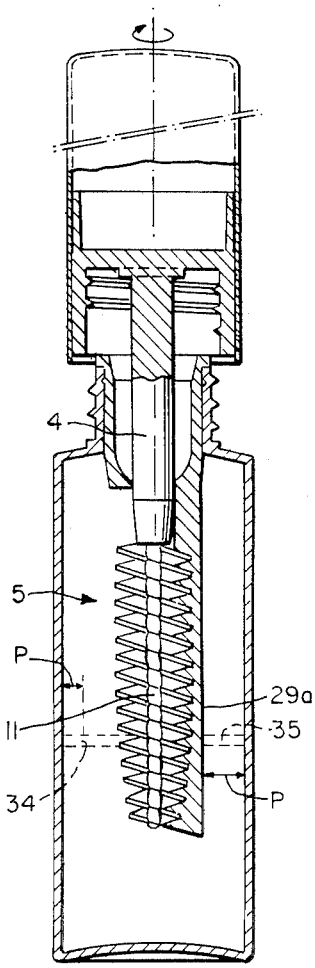
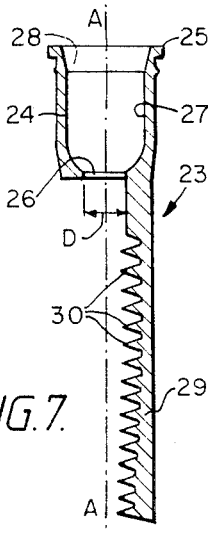
FIG. 7.

MATERIAL APPLICATOR ASSEMBLY AND WIPER THEREFOR

FIELD OF THE INVENTION

The present invention relates in general to material applicator assemblies in which as an elongate applicator, such as a brush, is withdrawn from a container containing material to be applied by the applicator, it passes through a wiper orifice which both cleans a plain shank portion of the applicator, and removes excess material from the applicator, so as to regulate the amount of material retained on the withdrawn applicator. More particularly, the invention relates to the wiping arrangement which effects this wiping of the applicator.

The invention is particularly, but not exclusively, concerned with applicator assemblies for cosmetics material, such as mascara or other compositions.

DESCRIPTION OF THE PRIOR ART

FIG. 1 illustrates a known container/applicator assembly comprising a container 1 containing a mass of mascara or other cosmetics material 2, and an applicator having an elongated head portion 3 and an axially projecting shank 4 from which projects a brush 5 or other elongate member having surface formations capable of retaining the cosmetics material. The shank 4 projects from and is integrally molded with a plastics cap insert 3*a* which fits over and engages the neck 6 of the container in the closed position. In the example shown in FIG. 1, the cap 3*a* push-fits onto the neck of the container to retain the applicator firmly attached thereto. Accommodated within the neck of the container 1 is a wiper insert 7 which comprises a tubular portion 8 extending through the neck and fitting tightly therein, and having at its outer end an outwardly projecting flange 9 which sits on the rim of the neck. At this outer end of the wiper insert the opening into the passageway through it is chamfered at 8*a* to provide a somewhat enlarged opening to assist reinsertion of the applicator after use.

The brush 5 is, in the arrangement shown, of the type having a twisted wire stem 11 carrying outwardly projecting bristles or other cosmetics-retaining elements or material 12. The upper part of the twisted wire stem is fixed axially within the shank 4 having as shown, a diameter D which is substantially equal to the inside diameter of the tubular part 8 and is considerably larger than the diameter of the stem 11.

In use, as the applicator is withdrawn from the container, first the shank 4 and then the brush 5 passes through the tubular part 8 of the wiper 7. The mascara carried on that part of the shank normally within the container, and the excess mascara on the brush 5 is wiped as the shank and brush successively enter the wiper orifice provided by the opening at the inner end of the tube 8. Thus, the shank is cleaned and only a regulated amount of mascara is retained on the withdrawn brush.

FIGS. 2 and 3 illustrate, respectively, the applicator and container 1 of another known cosmetics applicator assembly. In this alternative, the cap screw fits onto the neck of the container, and the wiper insert 7' located in the container neck has a through-passage which is profiled in longitudinal section rather than being a constant diameter bore as in the arrangement shown in FIG. 1. The wiper insert shown in FIG. 3 has at its inner and a wiping orifice 14', which opens to a larger diameter central passage portion 15' and a chamfered, or flared outer portion 16'.

Both of these systems work reasonably well, but they suffer the common problem that material tends to become compacted in the interstices between the bristles, this compacting being worst at the radially inner parts of the bristles 12 adjacent the stem 11 lying within an imaginary cylinder which is of the same diameter D as, and an extension of, the shank 4. FIG. 4 illustrates the manner in which this tends to occur. As shown, on entering the wiper, the bristles 12 are deflected forwardly until their outer ends have passed through the wiper orifice 14'. For each bristle, this forward deflection increases as the part of the stem 11 in which it is rooted moves through the wiper. This causes the bristles just beneath the wiper to bunch tightly together close to the stem, causing compression of the material disposed in the interstices between the bristles.

Accordingly, it is really only the outer tips of the bristles which are actually wiped directly by the wiping orifice, the wiper providing a squeezing acting to force some of the material radially outwardly between the bunched bristles. However, because there is no direct wiping along the lengths of the bristles part of the material remains and becomes compressed between the bristles, particularly in the region close to the stem. Such compression causes the material to accumulate and over a period of use creates a compacted mass within this cylindrical region adjacent the stem.

This accumulation is very undesirable as it impairs the efficiency with which the brush is reloaded with fresh material each time it is reinserted into the container. Furthermore, the residue can cause problems of hygiene.

In my UK Pat. No. 2071558, I have described a method and apparatus for integrally molding a miniature makeup brush from a suitable plastics material. An example of a brush made by this process is illustrated in FIG. 5, and comprises an elongate shank 17 integrally formed at one end with a reduced diameter stem 18. The stem 18 is integrally formed with a plurality of axially extending, circumferentially distributed rows of flexible, radial teeth or bristles 19. FIG. 6 is an end-on view of the brush, and illustrates that between the rows of bristles 19 there are a number of axially extending, circumferentially spaced regions 20 lying between the inter-row curved land portions 21 of the outer surface of the stem 18, and the cylinder 22 which is an imaginary extension of the outer surface of the shank 17. When used in conjunction with a container having a wiper of the type illustrated in FIGS. 3 and 4, the diameter of the wiper orifice will correspond with the diameter of the shank 17. As the applicator is withdrawn through the wiper, the flexible bristles 19 will deflect forwardly in a fashion similar to that described with reference to FIG. 4, and material will tend to accumulate in the above-mentioned spaces 20 adjacent the stem 18.

SUMMARY OF THE INVENTION

The present invention is addressed to this problem and seeks in its broadest aspect to avoid it by providing, in association with a wiper unit having a wiping orifice for wiping a material-retaining portion of the applicator, at least one cleaning member which is arranged to penetrate into a part of the material-retaining portion thereby to dislodge the material from this part.

According to one aspect of the present invention there is provided a material applicator assembly comprising an elongate applicator, a container for the material to be applied by the applicator and a wiper unit having a wiping orifice for wiping a material-retaining portion of the applicator as it is withdrawn from the container so as to limit the amount of material retained thereon, a cleaning member being provided which is adapted to project inwardly relative to the orifice and penetrate an inner part of said material-retaining portion to aid the removal of material from said inner part of material.

The cleaning member may be attached to or integral with the wiper unit.

Therefore, according to another aspect of the present invention there is provided, in or for a material applicator assembly comprising an elongate applicator and a container for the material to be applied by the applicator, a wiper unit having a wiping orifice for wiping a material-retaining portion of the applicator as it is withdrawn from the container so as to limit the amount of material retained thereon, said wiper unit further having a cleaning member which is adapted to project inwardly relative to the orifice for penetrating an inner part of said material-retaining portion to aid the removal of material from said inner part.

As in the above-described known arrangements the wiper unit can be adapted to fit in the neck of the container opening.

This cleaning member may comprise one or more legs extending from the wiping orifice inwardly of the container so as to permit this inner part of the brush, or other material-retaining portion, to be cleaned when the applicator is in a partly withdrawn position where the brush lies just inside the container. Alternatively, the leg or legs could depend somewhat further to such position that the brush could be cleaned by rotation in a lower position in which it is disposed in the mass of material to be applied, thereby to assist the refreshing of the brush with new material.

It is also possible that the cleaning member could project inwardly into the wiping orifice, or some other part of the wiper unit itself so that the brush would be cleaned at a position within the neck of the container. In this arrangement, the shank of the applicator would be formed with a groove for accommodating the cleaning member while the applicator is attached to, and also while being removed from the container.

The cleaning member need not be attached to, or part of, the wiper unit. It could instead be attached to, or integral with the inside of the container. For example it could be integrally moulded with the container so as to project upwardly from its base, or inwardly from its side wall.

Furthermore, means may be provided to vary the degree of the inward projection of the cleaning member so as to control the cleaning effect which it provides. Where the cleaning member is part of the wiper unit, this means may comprise a cam surface which projects inwardly from the inside wall surface by an amount which varies in a rotational sense about the axis of the applicator of the container. The cleaning member would bear resiliently against this cam surface, and rotation of the wiper unit in the container neck would cause the cleaning member to ride along this surface and would thereby cause its inward projection to vary.

In a further aspect, the present invention seeks to alleviate the described problem by providing a cleaning member arranged to penetrate the bunched bristles at a position before their passage through the wiping orifice on withdrawal of the applicator through the wiper.

Therefore, according to this further aspect of the present invention, there is provided a material applicator assembly comprising an elongate applicator, a container for the material to be applied by the applicator and a wiper unit having a wiping orifice for wiping a material-retaining portion of the applicator as it withdrawn from the container so as to limit the amount of material retained thereon, at least one cleaning member being provided to penetrate the material-retaining portion at a position before its entry into said wiping orifice.

In a disclosed embodiment of this further aspect of the invention, a plurality of said cleaning members are provided and are arranged circumferentially spaced about the axis extending through the wiper orifice. Such cleaning members may be attached to or integral with the wiper unit, and they preferably extend obliquely from the base of the unit at circumferentially spaced positions beneath the wiper orifice downwardly and inwardly toward the axis through the wiper so as to penetrate a radially inner part of the material-retaining portion lying within the diameter of the wiping orifice. These cleaning members can flex radially outwardly so as to allow the passage of a shank portion of the applicator to be withdrawn through and wiped by said wiping orifice.

According to yet another aspect of the present invention there is provided, in or for a material applicator assembly comprising an elongate applicator and a container for the material to be applied by the applicator, a wiper unit having a wiping orifice for wiping a material-retaining portion of the applicator as it is withdrawn from the container so as to limit the amount of material retained thereon, said wiper unit further having a cleaning member which is adapted to penetrate the material-retaining portion at a position prior to its entry into said wiping orifice.

The wiping unit is preferably adapted to fit in the neck of the container opening.

The cleaning means preferably comprises a set of legs circumferentially spaced about the wiping orifice and extending from the wiping orifice inwardly of the container. In a described embodiment, these legs project obliquely inwardly toward the wiper axis so as to penetrate a radially inner part of the material-retaining portion within the diameter of the wiping orifice.

In a preferred embodiment, the elongate applicator comprises a shank carrying the material-retaining portion at one end thereof, the shank being formed with a recess or recesses spaced axially from said material-retaining portion, for accommodating said cleaning member or members. With such a structure, it can be arranged that the radially resilient cleaning member or members relax into the recess or recesses in the fully inserted position of the applicator, this being the normal position of the applicator when it is not being used. There may be a single recess in the form of an annular waist so that the member or members can relax in any angular position of the applicator shank. However, one or more circumferentially limited recesses, e.g. slots may provide a similar beneficial effect.

With such an arrangement, long-term outward stressing of the cleaning members and resulting reduction of flexibility is avoided, so that they can remain effective for assisting cleaning of the material-retaining portion over a long period of use. Furthermore, it may be arranged that a part of the wiper unit defining said wiping orifice also is accommodated in the recess when of annular form. If so, the material of the orifice-defining part of the wiper may be resilient, the normal unstretched diameter of the wiper orifice being less than the diameter of the shank portion between the annular recess and the material-retaining head portion. The orifice will thus normally be unstretched, but when the applicator is withdrawn, it will stretch as the shank is withdrawn so as to provide an improved cleaning of the outer shank surface. As the material-retaining head portion of the applicator reaches the wiping orifice, the orifice and the cleaning members will relax radially inwardly so as to effect wiping and cleaning of the head portion.

Particular embodiments of the invention will now be described by way of example with reference to FIGS. 7 to 16 of the accompanying drawings.

BRIEF DESCRIPTION OF THE DRAWINGS

FIG. 7 illustrates in longitudinal section a wiper unit in accordance with the present invention, FIG. 8 illustrates in part longitudinal section a cosmetics product container incorporating the wiper unit of FIG. 7;

FIG. 9 illustrates, in part longitudinal section, the cosmetics product container of FIG. 8 together with an applicator located in the position at which it can be cleaned;

DESCRIPTION OF THE PARTICULAR EMBODIMENTS

Figure 1:
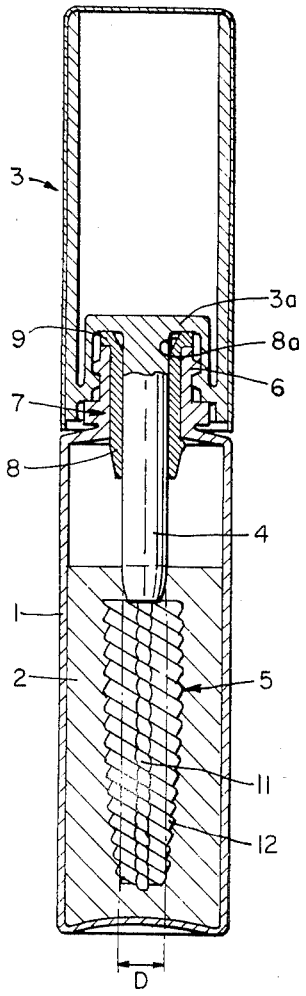
PRIOR ART FIG. 1.
FIG. 1 illustrates, in part longitudinal cross-section, a known cosmetics applicator assembly.
Figure 2:
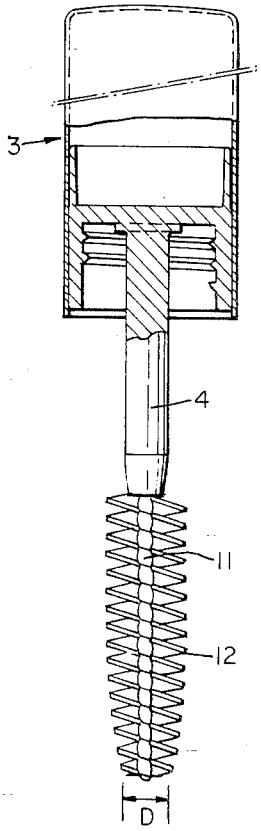
PRIOR ART FIG. 2.
FIGS. 2 and 3 illustrate in part longitudinal section the applicator and container portions of a alternative known cosmetics applicator assembly.
Figure 3:
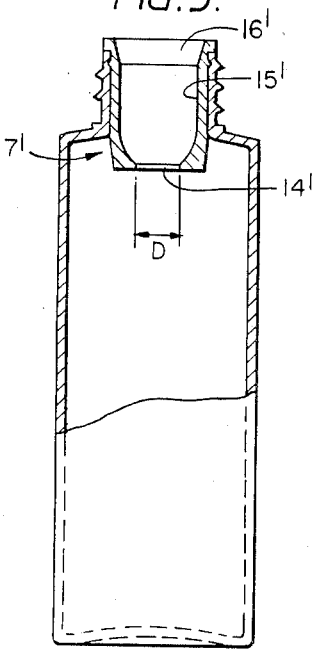
PRIOR ART FIG. 3.
Figure 4:
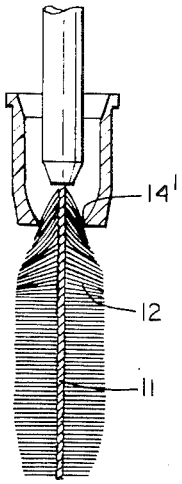
PRIOR ART FIG. 4.
FIG. 4 illustrates in longitudinal section the withdrawal of a known cosmetics applicator through a wiper unit.

With reference to FIG. 7, there is shown a wiper unit 23 to be inserted into the neck of a cosmetics container 1 for wiping excess material from a brush or other material-retaining member of an applicator as it is withdrawn through the container neck. The wiper comprises, as in the wiper of FIG. 3, a short cylinder 24 having at one end an outwardly projecting annular flange 25 which, when the wiper unit is push-fitted into the container neck, sits on the rim of the neck 6 of the container, as shown in FIG. 8. The other end of this cylinder 24 defines a wiping orifice 26 of somewhat smaller diameter than that of the major portion 27 of the bore through the wiper, this passage flaring outwardly at 28 at the outer end. Incidentally, this contouring of the passage within the wiper renders reinsertion of the brush into the container somewhat easier than in the case of the straight cylindrical bore of FIG. 1.

A cleaning member in the form of a depending leg 29 is attached to, or integrally formed with the wiper so as to extend from the end of the cylinder 24 adjacent the wiping orifice 26 parallel to the axis through the wiper. The inner part of this leg closest to the A axis is formed with a profile which projects inwardly toward that axis relative to the orifice diameter D so that when, as shown in FIG. 9, the applicator is disposed in a position where the brush 5 is adjacent this profiled part of the leg, this latter part penetrates into the inner part of the brush lying adjacent its stem 11 and within the axial extension of the diameter of the wiping orifice, this being equal to the diameter of the shank 4 of the applicator. In this embodiment, this profile of the inner edge of the leg comprises a row of teeth 30 which can penetrate the interstices of the flighting of a helical brush in the manner shown in FIG. 9. Preferably, the spacing of the teeth corresponds substantially to the pitch of the helical bristle flighting. With this arrangement, the cleaning effect of the teeth by dislodging the mascara or other product close to the brush stem is maximised.

As shown in FIG. 9, the toothed profile of the leg is adapted and positioned so that it will penetrate the interstices of the brush just prior to removal of the brush through the wiping orifice 26; rotation of the applicator at this point about its longitudinal axis, as shown, will cause the teeth to scrape all around the central stem 11 so that the whole of the central core of the brush can be cleaned of the cosmetic product.

By lengthening the leg the arrangement can be adapted so that the brush is to be cleaned by rotation while it is nearer to the base of the container, surrounded by the mass of the cosmetic material, thereby to assist the refreshing of the brush with new material.

It should be noted that although in the above embodiment the toothed part of the leg is made long enough to clean the whole length of the brush, it may be desirable or sufficient to provide cleaning of only a part of the brush length, in which case this toothed part can be shortened.

It is also envisaged that the depending leg 29 could be replaced by a cleaning member projecting inwardly from the wall of the passage in the cylinder 24 of the wiper unit, for example from the portion 27. Such projections would extend inwardly to a point within the diameter of the wiping orifice 26 so that the brush core could be cleaned by rotation within this main part of the wiper unit. The radially inner part of such a cleaning member lying within the wiper orifice diameter would be accepted within a longitudinal groove formed in the shank of the applicator so as to allow this shank to pass through the wiper unit.

It should be noted that other profiles on the leg could provide the necessary projection to produce the desired core-cleaning effect within the diameter of the main wiping orifice. The nature of this profile will also depend to some extent upon the construction of the material-retaining portion and the nature of the product retained therein. While a bristle brush is well suited for very thick cosmetic products such as mascara, other constructions and materials may be more suitable for thinner, more fluid products.

It will be understood from the above description and FIGS. 7 to 9 that reference herein to a projection of the cleaning member inwardly relative to the wiping orifice is to be taken as including inward projection at a position axially spaced from the wiping orifice within the container.

Figure 10:
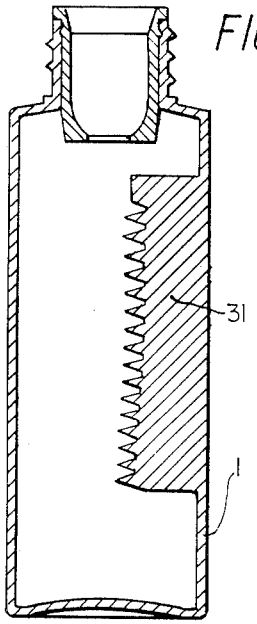
FIG. 10 illustrates in part longitudinal section a first modified form of the cosmetics product container of FIG. 8.
Figure 11:
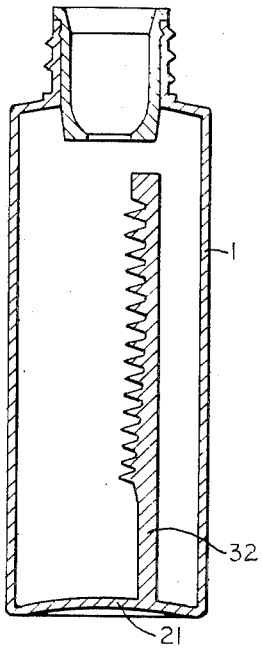
FIG. 11 illustrates in part longitudinal section a section modified form of the cosmetics product container of FIG. 8.

A similar cleaning effect to that provided by the toothed leg 29 can be obtained by another arrangement as illustrated in FIG. 10. Here, instead of being integrally formed with the wiper, the cleaning member is in the form of an elongate web 31 extending axially of, and integrally formed with, the container and projecting radially inwardly from the inside surface of its sidewall at a predetermined circumferential position. The elongate inner edge of this cleaning web 31 can again be profiled, e.g. toothed, to give maximum cleaning of the inner part of the applicator. This web 31 can be axially positioned according to the position at which the applicator is to be cleaned, for example, just prior to withdrawal through the wiping orifice, or at the fully inserted position The cleaning member can be integral with the container in an alternative arrangement as illustrated in FIG. 11. Here, the cleaning member is in the form of an elongate member 32 extending up from the inside of the container base 33. Once again, the length and profiling of this member 32 can be determined according to the applicator type and its desired cleaning position.

In each of the above-described embodiments, the arrangement may be modified to allow the inward radial projection of the cleaning leg 29, web 31, or member 32 to be adjusted for varying the degree of interstitial cleaning of the brush 5, or more generally of the cleaning of the radially inner part of the applicator. For example, in the embodiment of FIGS. 8 and 9, the leg 29 can be resiliently displaceable in a radial sense by a camming action using a cam surface 34 on a cam member 35 projecting radially inwardly from the container sidewall. The cam member extends circumferentially at least part way round the container and its inward projection P varies according to the circumferential position. In this modification, the wiper unit is adapted to be rotatable in the container neck, and as it is rotated the outer edge 29*a* of the leg rides along the cam surface 34 causing the leg to flex radially to provide a greater or lesser radial inward projection. The leg will be so formed that throughout the range of radial positions it resiliently bears against the cam surface 34.

Instead of providing this radial adjustment by flexing of the leg 29, it may be hinged to the underneath of the wiper unit to pivot radially by a similar camming action to that described above, the hinged leg being biased by some means to bear against the cam.

Figure 12:
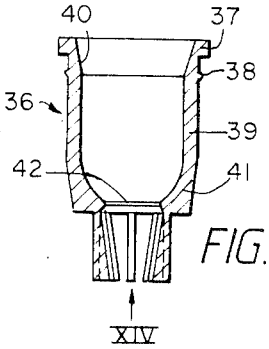
FIG. 12 is a longitudinal section through another wiper unit of a construction in accordance with the present invention.
Figure 14:
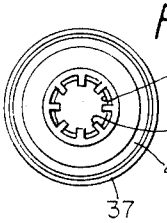
FIG. 14 is an end view of the wiper unit of FIG. 12 as viewed axially in the direction XIV.
Figure 13:
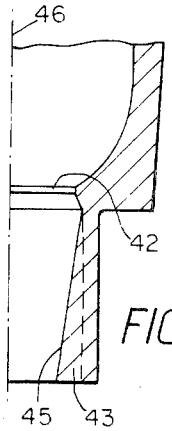
FIG. 13 is an enlarged detail showing part of the wiper unit of FIG. 12.

The wiper unit shown in FIGS. 12 to 14 is a generally cylindrical member 36 which fits tightly into the neck 6 of a container 1 for containing a quantity of a liquid, semi-liquid, creamy or viscous cosmetics material. The cylinder is preferably integrally molded from a suitable plastics materials and has at its upper end an outwardly projecting annular flange 37 which engages the upper annular rim of the container neck. Just beneath this flange 37, the outer cylindrical wall of the wiper unit is formed with an annular rib 38 which engages in an annular groove formed in the inner cylindrical wall of the neck. The cylindrical member 36 defining the wiper unit has a central, generally cylindrical portion 39 an upper funnel-shaped portion 40, and a lower portion 41 which tapers inwardly toward a wiping orifice 42.

A series of circumferentially spaced legs is integrally formed with the cylindrical member 36, and constitutes a cleaning means for penetrating the bunched bristles immediately before they enter the wiping orifice 42. In the disclosed embodiment eight such legs 43 are provided, each comprising a substantially wedged shaped element attached at its upper narrow end to the cylindrical member 36 adjacent the periphery of the wiping orifice 42, and having an inner edge 45 (see FIG. 13) which extends obliquely inwardly toward the axis 46 extending centrally through the wiping orifice 42.

The legs 43 can flex outwardly about their points of attachment to the base of the cylindrical member 36 so as to accommodate the full diameter of a cylindrical shank portion as it passes through the wiping orifice 42 either inwardly or outwardly relative to the container. On withdrawal of the applicator, the legs 43 flex inwardly as the bottom of the shank passes upwardly through the cleaning member, so that they can then penetrate the bunched bristles, or other material-retaining filaments just as they are about to enter the wiping orifice. In the described embodiment, the legs penetrate an inner part of the material-retaining portion lying adjacent the central stem within the diameter of the wiping orifice. However, a beneficial effect can be achieved even if the inner edge of the legs were to extend parallel to the axis 46, i.e. with no inward slant. In either case, the effect of the legs is to dislodge the material at the point where it tends to become compacted between the bristles or filaments where they bunch prior to entry into the orifice.

Figure 15:
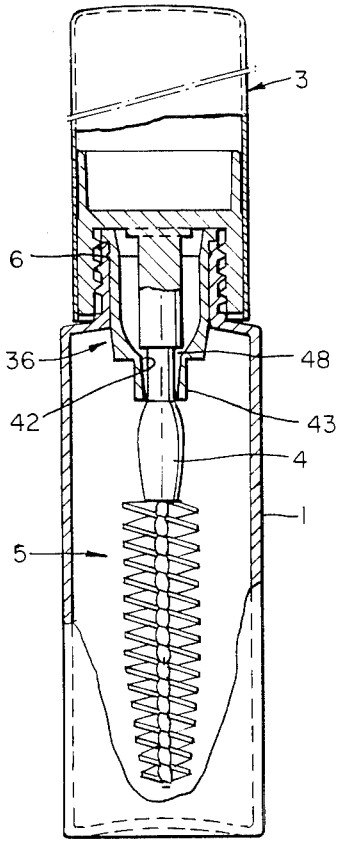
FIG. 15 is a longitudinal section through a material applicator assembly including a material container, the wiper unit of FIGS. 12 to 14, and a material applicator.

FIG. 15 illustrates a preferred embodiment of a cosmetics dispenser assembly incorporating a wiper unit as described above with reference to FIGS. 12 to 14. In this assembly, the applicator comprises a twisted wire stem brush 5 mounted at the end of a carrier shank 4 which is attached at its other end to a closure cap 3 which is internally screw threaded so that it can be secured to the screw threaded neck 6 of the container 1. In FIG. 15, the assembly is shown with the cap 3 tightly secured to the container neck. The shank 4 is formed with an annular waist or recess 48 which in this fully inserted position of the applicator accommodates the lower rim portion of the wiper unit defining the wiping orifice 42 and the cleaning legs 43. The radial depth of this waist is such that the orifice is unstretched and the legs are fully relaxed when accommodated therein. The waist therefore extends the shelf life of the device by avoiding long term stretching of the orifice and outward flexing of the legs. Such stretching and outward flexing only occurs as the applicator is withdrawn from, and reinserted into the container.

Figure 5:
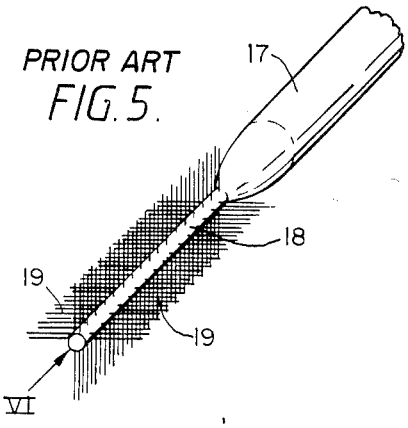
PRIOR ART FIG. 5.
FIG. 5 illustrates in perspective an integrally moulded cosmetics applicator previously proposed by the applicant.
Figure 6:
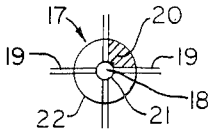
PRIOR ART FIG. 6.
FIG. 6 is an end-on view of the applicator of FIG. 5 as seen in the direction VI.

Although the above described embodiment of the wiper unit has a plurality of cleaning elements, it will be appreciated that a single depending cleaning element will provide a beneficial cleaning effect. On each withdrawal of the applicator, the single cleaning element would in all probability penetrate a different circumferential portion of the bunched bristles, thus inhibiting the accumulation which tended to occur with repeated use.

Where the applicator is of the integrally molded kind illustrated with reference to FIGS. 5 and 6, the construction of the cleaning elements to project obliquely inwardly toward the wiper axis is of particular benefit in providing a wiping of the surface lands 21 of the head stem 18. Again, it is preferable that the cleaning means should comprise the set of circumferentially spaced cleaning elements as illustrated in FIGS. 12 to 14 so as to achieve simultaneous cleaning of several (ideally all) of the lands 21, but it will be appreciated that even if only one such cleaning element is provided, it is probable that different lands 21 will be cleaned on successive withdrawals of the applicator so as to prevent long term accumulation of the material in the regions adjacent the stem 18.

Figure 16:
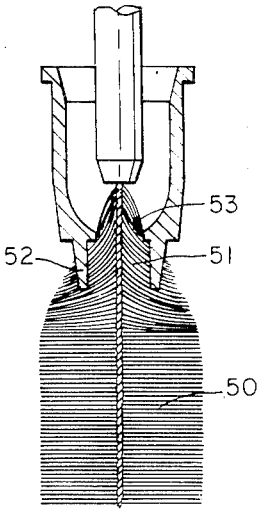
FIG. 16 is a longitudinal section through a modified form of wiper unit in accordance with the invention, shown during withdrawal of a twisted wire stem applicator.

In the above described embodiment of the invention, the inner edge or edges of the cleaning element or elements 43 extend obliquely inwardly toward, or parallel to the wiper axis. In some cases, the wiper element or elements may be disposed radially outwardly of the wiper orifice. FIG. 16 illustrates such an arrangement. Here, the bristles or filaments 50 of the applicator are relatively long, and the bunched region 51 of the brush can be penetrated by one or more depending legs 52 attached to the base of the wiper at a position or positions spaced radially outwardly of the wiping orifice 53. Again, the effect of these cleaning legs 52 is to loosen and dislodge cosmetic material from between the filaments 50 just at the point where the filaments bunch and would normally tend to compact the material.

It should be noted that it is not essential for the leg or each of the legs constituting the cleaning means to be of a slender construction with little circumferential extent. It would, for example, be possible to use a wider depending element which extends circumferentially up to, or even more than 180° around the axis through the wiper, provided such element, or (if there is more than one) elements do not define a circumferentially complete orifice. A combination of slender and wide elements could also be used.

It will be appreciated that the invention is not limited to the particular constructions described above, and that modifications may be apparent to those skilled in the art. For example, although in each of the described embodiments of FIGS. 7 to 9 and 12 to 16, the cleaning members are integrally attached to, or formed with the wiper unit, they may be formed on a separate element, e.g. a carrier ring which is assembled together with the wiper unit within the container neck.

I claim:

1. A material applicator assembly comprising an elongate applicator, a container for the material to be applied by the applicator, a wiper unit having a wiping orifice for squeezing and wiping a material-retaining portion of the applicator upon its withdrawal from the container to limit the amount of material retained thereon, and a cleaning member adapted to project inwardly relative to the orifice and penetrate an inner part of said material-retaining portion to aid the removal of material from said inner part, said cleaning member being flexible radially outwardly to allow the passage of a shank portion of the applicator to be withdrawn through and wiped by the wiping orifice, the shank portion being formed with at least one recess spaced axially from said material-retaining portion for accommodating said cleaning member when the applicator is fully inserted into the container.

2. An assembly according to claim 1 wherein the cleaning member is attached to the wiper unit.

3. An assembly according to claim 2 wherein the cleaning member comprises at least one leg extending from a position adjacent the wiping orifice inwardly of the container.

4. As assembly according to claim 3, wherein said at least one leg is integral with the wiper unit.

5. An assembly according to claim 1 wherein said cleaning member comprises a plurality of circumferentially spaced legs which project inwardly of the container from positions adjacent the wiping orifice so as to penetrate said inner part.

6. An assembly according to claim 5 wherein said legs are attached to the wiper unit.

7. An assembly according to claim 5 wherein said legs extend obliquely from the base of the wiper unit at circumferentially spaced positions beneath the wiper orifice downwardly and inwardly toward the axis through the wiper unit, and can flex radially outwardly so as to allow a shank portion of the applicator to be withdrawn through and wiped by said wiping orifice.

8. An assembly according to claim 1, wherein there is provided means for varying the degree of the inward projection of the cleaning member relative to the orifice so as to control the penetration of said inner part.

9. An assembly according to claim 1 wherein the recess is of annular form and is arranged to accommodate also that part of the wiper unit defining said wiping orifice when the applicator is full inserted.

10. An assembly according to claim 1, wherein the cleaning member is integral with the wiper unit.

11. A material applicator assembly comprising an applicator having an elongate shank and a material retaining portion formed by a plurality of bristles extending generally radially from the shank, a container for the material to be applied by the applicator and having an opening to receive the applicator, a wiper mounted in the opening of the container and defining a wiper orifice through which the bristles pass upon withdrawal of the applicator from the container, the wiping orifice having a cross-sectional size less than the cross-sectional size of the material retaining portion such that the bristles are bent over by the wiper upon withdrawal of the applicator and are squeezed to limit the amount of material retained by the bristles, and at least one cleaning member having a cleaning projection, the cleaning projection being disposed inwardly of the container relative to the wiper orifice and projecting into a path of travel of the bristles during removal of the applicator from the container to penetrate between the bristles to dislodge material therebetween prior to bending and squeezing of the bristles by the wiper.

12. An assembly as claimed in claim 11, wherein the applicator is removable from the container by longitudinal movement along an axis of the applicator and the cleaning projection comprises a cleaning leg depending from the wiper and projecting therefrom generally side-by-side with the axis of the applicator to project into the material retaining portion of the applicator in a longitudinal direction of the applicator upon withdrawal of the applicator from the container.

13. An assembly as claimed in claim 12, wherein a plurality of cleaning legs are provided, each depending from the wiper and spaced apart from each other around said axis.

14. An assembly as claimed in claim 13, wherein the legs define a clear passageway therebetween having a cross-sectional size smaller than the wiper orifice.

15. An assembly as claimed in claim 12, wherein the shank of the applicator has a recessed portion to accommodate the leg when the applicator is fully inserted into the container and a wider portion between the recess portion and the material retaining portion which is wiped by the wiper upon withdrawal of the applicator from the container.

16. An assembly as claimed in claim 15, wherein the recessed portion is of annular form and is arranged to accommodate that part of the wiper defining the wiper orifice when the applicator is fully inserted into the container.

17. An assembly as claimed in claim 12, wherein the cleaning leg is integrally formed as one piece with the wiper.

18. An assembly as claimed in claim 12, wherein the cleaning leg is flexible.

19. An assembly as claimed in claim 11, wherein the material retaining portion has a circular cross-section.

* * * * *

UNITED STATES PATENT AND TRADEMARK OFFICE

CERTIFICATE OF CORRECTION

PATENT NO. : 4,802,797

DATED : Feb. 7, 1989

INVENTOR(S) : Rodney D. Cole

It is certified that error appears in the above-identified patent and that said Letters Patent is hereby corrected as shown below:

On the title page, item [30] Foreign Application Priority Data, "May 22, 1985" should read --May 21, 1985-- and "Mar. 5, 1986" should read --Mar. 4, 1986--.

Signed and Sealed this

Fifteenth Day of May, 1990

*Attest:*

HARRY F. MANBECK, JR.

*Attesting Officer*

*Commissioner of Patents and Trademarks*